United States Patent [19]

Veselka

[11] Patent Number: 4,691,402

[45] Date of Patent: Sep. 8, 1987

[54] ADJUSTABLE SINGLE LOCK GUTTER BROOM MECHANISM

[76] Inventor: Kenneth R. Veselka, Rte. 1, Box 107V, Axtell, Tex. 76624

[21] Appl. No.: 843,633

[22] Filed: Mar. 25, 1986

[51] Int. Cl.[4] ..... F01H 1/04

[52] U.S. Cl. ..... 15/87

[58] Field of Search ..... 15/82–87, 15/340

[56] References Cited

U.S. PATENT DOCUMENTS

| | | | |
|---|---|---|---|
| 1,407,180 | 2/1922 | Todd | 15/87 |
| 1,452,307 | 4/1923 | Martin | 15/87 |
| 1,750,829 | 3/1930 | Wilson | 15/87 |
| 2,991,492 | 7/1961 | Dear et al. | 15/87 |
| 3,790,981 | 2/1974 | Young | 15/87 |
| 4,335,482 | 6/1982 | Jones | 15/87 |

*Primary Examiner*—Edward L. Roberts

*Attorney, Agent, or Firm*—Diller, Ramik & Wight

[57] ABSTRACT

A gutter broom mechanism is adapted to be carried by the frame of a mobile road or like surface sweeping machine, a gutter broom carried by a first end of an arm having a second end mounted to the frame for movement such that the gutter broom can be moved between a first elevated position generally adjacent the frame and a second lower position generally outward of the frame in brushing engagement with a surface to be swept, the arm carrying a ball joint/yoke to which a threaded bolt is connected by a first pivot pin, the bolt passes through a collar having a spherical socket receiving a spherical surface of the yoke, the threaded bolt being connected by a nut to a bracket supporting a rotary gutter broom, and the threaded bolt and nut defining a single locking mechanism for holding the gutter broom in anyone of a plurality of predetermined positions of angular adjustment relative to an associated gutter or similar surface being swept.

38 Claims, 6 Drawing Figures

ADJUSTABLE SINGLE LOCK GUTTER BROOM MECHANISM

BACKGROUND OF THE INVENTION

This invention is directed to an improvement in a surface sweeping machine equipped with a gutter broom, and particularly an improvement in a gutter broom mechanism of the type disclosed in commonly assigned U.S. Pat. No. 3,790,981 in the name of Bernard W. Young issued on Feb. 12, 1974, the disclosure of which is fully incorporated herein to by reference and is made a part hereof, particularly in regard to the specifics of the hydraulic system for rotating the gutter broom and moving the same between its elevated inboard inoperative position and its lower outboard ground engaging/brushing position.

It is conventional for sweeping machines to include one or more gutter brooms or gutter brushes which are designed to be moved from an elevated inoperative position adjacent the associated vehicle frame to a lower operative position at which time an associated gutter broom motor which is normally hydraulically rotated is actuated to rotate the gutter broom. While the gutter broom includes a plurality of bristles whose ends occupy a common plane, the gutter broom is rarely operated with all of the bristles lying simultaneously against the surface which is to be swept. Instead the gutter broom is adjusted so that the forward facing bristles relative to the direction of vehicle travel engage the surface which is to be swept, whereas the rearward bristles are elevated. The gutter broom is rotated clockwise, as viewed from above on the driver's side of the vehicle or counterclockwise as viewed from above at the passenger's side of the vehicle to brush debris from the gutter forwardly and inwardly after which it can be picked-up by a conventional vacuum pick-up head. The gutter brooms are not only inclined forwardly, but also laterally outwardly, so that the forward and outwardmost bristles of the gutter broom "bite" or forcefully engage the gutter at the gutter line (most immediate the "curb") where, due to the inclination of most gutters, most of the debris, silt, paper, etc. tends to accumulate.

It is, of course desirable for each gutter broom to complement as optimumly as possible each particular gutter which is being swept thereby, but for practical purposes this is virtually impossible. One cannot continually manually adjust and re-adjust gutter brooms as gutter styles/configurations/structures alter or vary. Instead, a gutter broom is normally adjusted for an "average" or "standard" gutter profile, and during a brushing operation satisfactory results can be expected. However, if a gutter broom is initially adjusted for a relatively shallow gutter and a very angulated or abrupt gutter is encountered, much of the debris in the more inclined gutter can be missed because the "bite" of the less angulated or tilted gutter broom will not effectively match the more abrupt angle of the gutter, particularly at the gutter line. Therefore, while effective brushing might take place away from the gutter line, the gutter line area with the predominant debris will not be effectively cleaned. Hence, it has been and remains desirable to adjust the angulation of the gutter broom to at least accommodate relatively drastic or abrupt changes in gutter configurations, angles, structures and the like.

Heretofore it has, of course, been recognized that rapid, accurate and reliable adjustment of a gutter broom relative to the gutter or similar surface which was to be swept was highly desirable. However, most efforts directed thereto have been rather cumbersome mechanical connections involving a plurality of bolts, nuts, holes, arcuate slots, pins, grooves, etc., typical of which are fairly represented in the patents to Gregory, J. Larsen (U.S. Pat. No. 3,825,968) issued July 30, 1974, Roland P. Gehman et al (U.S. Pat. No. 3,186,016) issued June 1, 1965, Hedley B. Keogh et al (U.S. Pat. No. 3,102,293) issued Sept. 3, 1963 and Robert F. Schmidt et al (U.S. Pat. No. 3,011,192) issued Dec. 5, 1961. Essentially all past effort toward achieving the objects of this invention lack any one or all of speed, simplicity and reliability. As might be expected, in those cases where a gutter broom could be adjusted and fixed in a position of adjustment, it took inordinate time involving the loosening and/removal of a plurality of bolts and nuts and subsequent relative adjustment between supporting plates to achieve eventual realignment, retightening and admitted reliability. However, the factors of speed of adjustment and simplicity thereof were lacking. Accordingly, the primary object of this invention is to provide a novel gutter broom mechanism in which the gutter broom can be rapidly, simply and reliably adjusted relative to its support arm thereby readily adapting the gutter brush mechanism for economically optimum and efficient gutter sweeping operations under most any type of gutter structures, profiles and/or inclinations.

SUMMARY OF THE INVENTION

In keeping with the present invention the primary object of achieving a speedy, simple and reliable adjustable connection between a gutter broom and its associated arm is created through a novel connection wherein two axes of movement are provided for the gutter broom relative to the arm supporting the same, yet the locking in any position of adjustment is achieved by a simple single locking mechanism.

A further object of this invention is a provision of a novel gutter broom mechanism as aforesaid wherein a first end of the arm is provided with a ball joint/yoke to which is connected by a first pivot pin one end of a threaded bolt, the bolt being received in a socket carried by a bracket supporting the gutter broom, the socket being a generally annular collar having an opening through which the threaded bolt passes, and a nut being connected to and tightened upon the threaded bolt which simultaneously draws the ball joint/yoke into the socket to create a binding fixed position of adjustment relative to the first pivot pin while simultaneously clamping the gutter broom support between the socket and the nut to simultaneously lock the support relative to a second axis of rotation defined by the axis of the threaded bolt.

Still another object of this invention is to provide a novel gutter broom mechanism as aforesaid wherein the socket defined by the annular collar includes a shallow annular recess opposing the gutter broom bracket or support for effecting binding engagement between the collar and the gutter broom bracket upon the tightening of the nut.

Still another object of this invention is to provide a novel gutter broom mechanism of the type heretofore described wherein the radius of the ball joint/yoke is greater than the radius of the socket creating an interference fit therebetween and an extremely tight clamping action when the nut is threaded upon the threaded bolt.

Still another object of this invention is to provide a novel gutter broom mechanism as aforesaid wherein the first pivot pin is prevented from inadvertent or accidental removal through an overlap within interior an annular surface of the collar in the locked position of the nut.

With the above and other objects in view that will hereinafter appear, the nature of the invention will be more clearly understood by reference to the following detailed description, the appended claims and the several views illustrated in the accompanying drawings:

DESCRIPTION OF THE PREFERRED EMBODIMENTS

Figure 1:
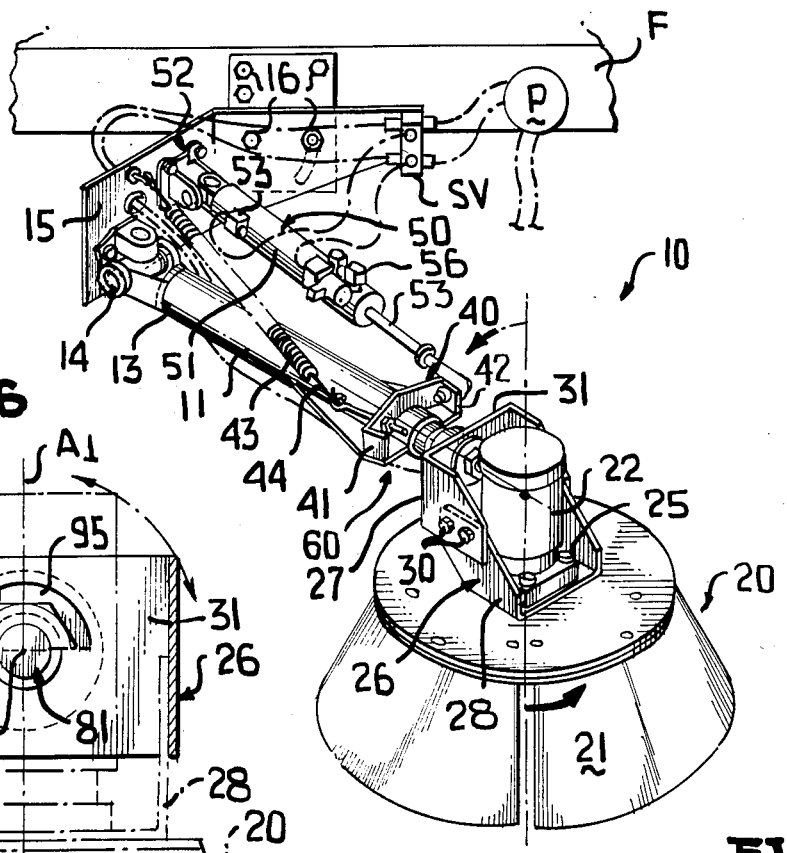
FIG. 1 is a perspective view of a novel gutter broom mechanism constructed in accordance with this invention and illustrates the same mounted on a vehicle side frame with the gutter broom connected to an arm through a novel connecting means of the present invention.

Reference is made to FIG. 1 of the drawings which illustrates a frame F of a mobile road sweeping or similar vehicle, such as the truck disclosed in U.S. Pat. No. 3,790,981. The frame F carries a gutter broom mechanism which is generally designated by the reference numeral 10.

Figure 2:
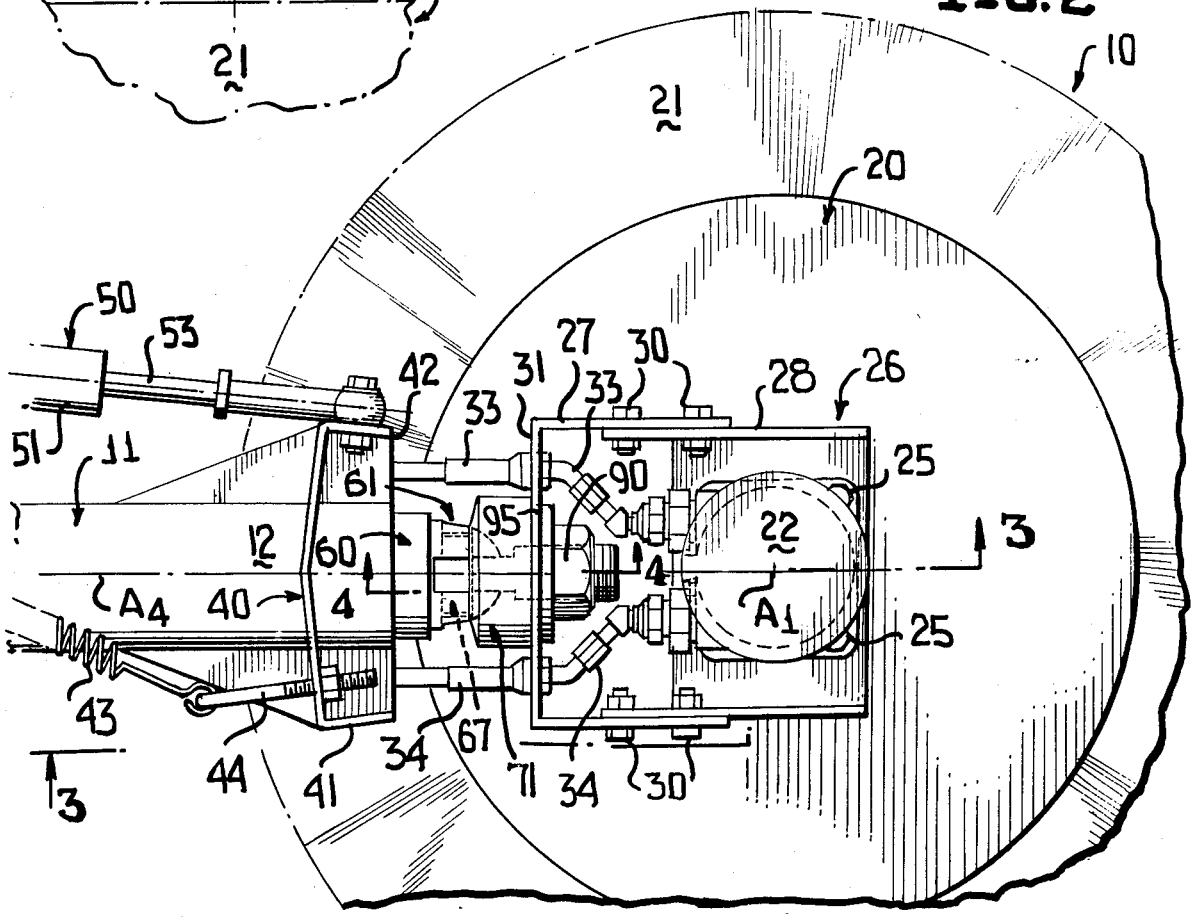
FIG. 2 is an enlarged fragmentary top plan view of the gutter broom mechanism, and illustrates a ball joint/yoke and socket/collar connection between the support arm and a bracket of the gutter broom.

The gutter broom mechanism 10 includes a boom or support arm 11 having a first end or end portion 12 and a second end or end portion 13 connected by a universal joint 14 to a plate 15 which is in turn connected by bolts 16 to the frame F. The universal joint 14 permits the arm 13 and an associated gutter broom 20 carried thereby to be moved between a first inoperative position at which the gutter broom 20 is elevated and is inboard and adjacent the frame F and a second operative position at which the gutter broom 20 is spaced sidewise away from the frame F, and bristles 21 thereof are in engagement with the surface being swept at the gutter brush 20 is conventionally rotated through a hydraulic motor 22 and its associated shaft 23 (FIG. 3) which is bolted, as at 24, to the gutter broom 20. The gutter broom motor 22 is itself connected by nuts and bolts 25 (FIG. 3) to a support 26 which includes two generally U-shaped bracket 27, 28 (FIGS. 1, 2 and 6) bolted to each other by nuts and bolts 30, or simply welded together in lieu of the nuts and bolts 30. The bracket 27 of the support 26 includes a bight or wall 31 having a circular opening 32 (FIGS. 4 and 5), as well as two other openings (unnumbered) through which pass hydraulic lines 33, 34 (FIG. 2) which are connected to the hydraulic motor 22 and to a pump P (FIG. 1) for rotating the gutter broom 20 about an axis of rotation A1 which can be selectively adjusted, as will be more apparent hereinafter.

The first end 12 of the arm or boom 11 carries another support or bracket 40 which is welded thereto and includes transverse opposite arms 41, 42. A spring 43 is adjustably connected by an adjustment screw 44 to the arm 41 and is also conventionally connected to the bracket 15. A fluid motor 50 includes a cylinder 51 connected by universal joint 52 to the bracket 15 and a rod 53 connected by a generally horizontal pivot pin 54 to the arm 42 of the bracket 40. A sequence valve SV, corresponding to the identically numbered valve in U.S. Pat. No. 3,790,981, is connected to ports 55, 56 (FIG. 1) of the cylinder 51 to selectively extend and retract the rod 53 to move the gutter broom 20 between the operative and inoperative positions heretofore described in the manner more clearly described in U.S. Pat. No. 3,790,981, and the total mechanism for so moving the gutter broom 20, in addition to the pump P and the valve SV, is again incorporated hereat by reference.

Novel means for connecting the gutter broom 20 to the end 12 of the arm 11 for pivoting movement about two axes A2, A3 (FIGS. 3-5) dispose generally normal to each other is generally designated by the reference numeral 60.

The connecting means 60 includes a first member in the form of a ball joint and yoke 61, another member in the form of a collar and/or socket 71, and a third member in the form of a rod or bolt 81.

Figure 6:
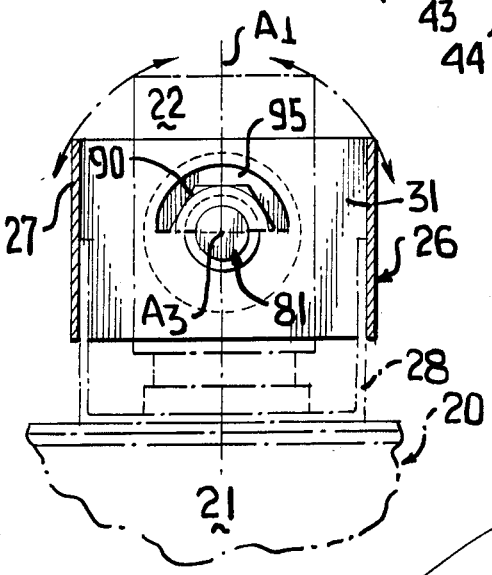
FIG. 6 is an enlarged sectional view taken generally along line 6—6 of FIG. 3, and illustrates clockwise/counterclockwise pivoting of the gutter broom support or bracket about the threaded bolt or pin.
Figure 4:
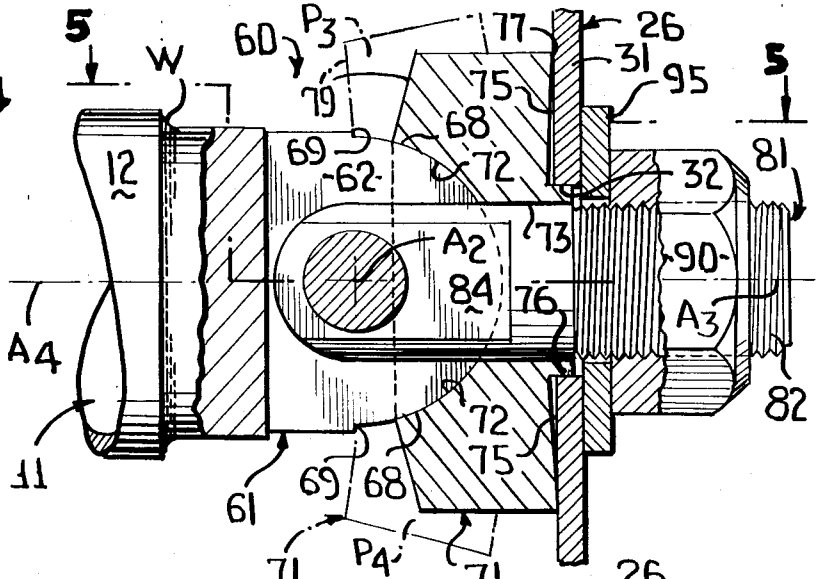
FIG. 4 is an enlarged fragmentary sectional view taken generally along line 4—4 of FIG. 2 and illustrates a pivot pin connecting an end of a threaded bolt to the ball joint/yoke, the threaded bolt passing through an opening of the socket/collar, through an opening of the gutter broom support, and a nut threaded thereto for simultaneously locking the gutter broom in any position of adjustment against movement about two pivot axes.
Figure 5:
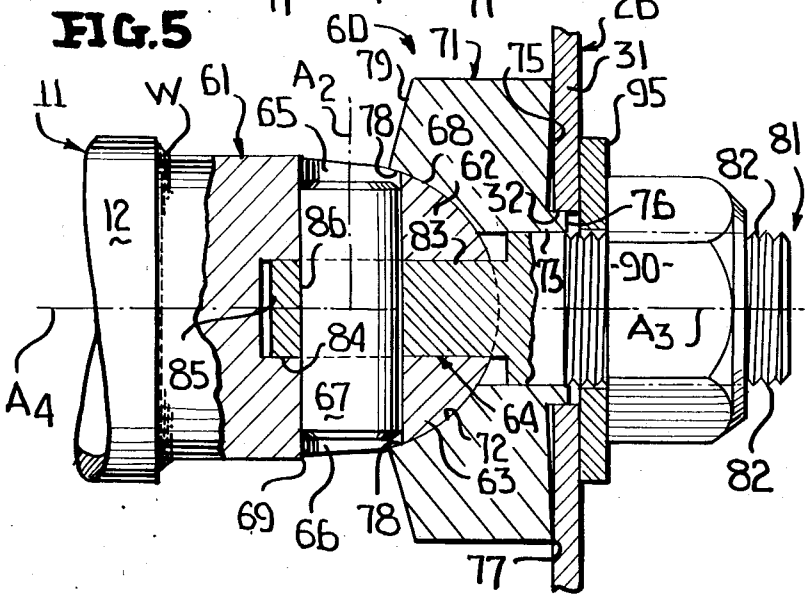
FIG. 5 is a cross sectional view taken generally along line 5—5 of FIG. 4, and illustrates details of the ball joint/yoke and socket/collar connection, together with an annular face of the socket/collar which prevents the pivot pin from being accidentally or inadvertently removed when the connection has been tightened.
Figure 3:
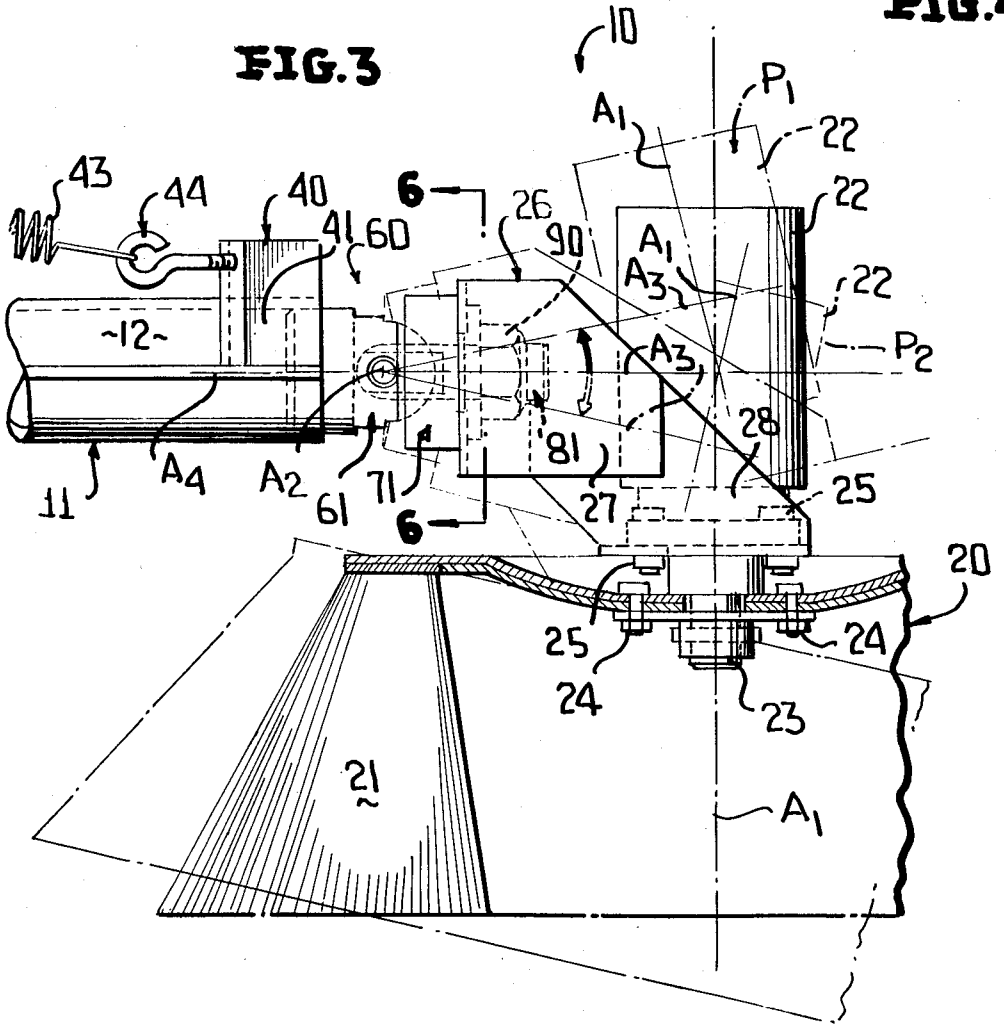
FIG. 3 is a fragmentary sectional view taken generally alone line 3—3 of FIG. 2, and illustrates in solid and phantom outlines several positions of relative adjustment of the gutter broom relative to the arm.

The member, ball joint and/or yoke 61 is partially inserted within the end 12 of the arm 11 and is rigidly connected thereto by an annular weldment W (FIGS. 4 and 5). The yoke or ball joint 61 is bifurcated and includes two legs or plates 62, 63 (FIG. 5) defining a groove or slot 64 therebetween and each having a respective circular bore 65, 66 housing ends (unnumbered) of a pivot pin 67 defining the pivot axis A2 which is disposed generally horizontally, as is best illustrated in FIG. 3, as well as being generally normal to an axis A4 of the arm 11 (FIGS. 4 and 5). A spherical or convex surface 68 of the legs 62, 63, though interrupted by the slot 64, defines essentially a ball joint with a similarly concavely curved spherical surface 72 of the member 71 which is generally of an annular configuration and includes an axial bore or opening 73. The radius of the spherical surface 68 is 1.00" whereas the radius of the concave spherical surface 72 is 0.980". The latter dimensioning effects a locking interference fit between the collar 71 and the yoke 61 when these two members are drawn into tight intimate locking engagement through the tightening of a nut 90 upon a threaded end portion 82 of the member 81. Opposite the threaded portion 82, the member 81 is provided with opposite relieved flat faces 83, 84 (FIG. 5) which correspond in size to the slot 64 and defined therebetween an end portion 85 having a bore or opening 86. The pivot pin 67 passes through the bore or opening 86 and thus pivotally attaches the end 85 to the yoke 61. The threaded end portion 82 of the member 81 passes freely through the opening 73 of the member 71, through the opening 32 of the bight 31 of the gutter broom support 26, and through a washer 95. As the nut 90 is tightened, the member 81 is drawn to the right, as viewed in FIGS. 4–5, and through the pin 67, draws the spherical surface 68 into binding interference locking engagement with the spherical surface 72 thereby locking the connection 60 which simultaneously prevents pivoting movement about the axis A2 and pivoting or rotational movement of the support 26 about the axis A3 of the member 81, in either a clockwise or a counterclockwise direction (FIG. 6). Thus, through the single locking means effected by the locking rotation of the nut 80 upon the threaded portion 82 of the member 81, any preselected position of the gutter broom axis A1 will be speedily, simply and reliably established and maintained, and if desired, just as easily speedily, simply and reliably readjusted and re-maintained. For example, if it is assumed that the axis of rotation A1 of the gutter broom 20 is vertical as shown in solid lines in FIG. 3 and the axis A3 of the threaded bolt 81 is horizontal and coincident with the arm axis A4 and normal to the axis A2, a change in this presumed relative orientation can be speedily achieved simply by first loosening the nut 90. At this point the interference fit between the surfaces 68, 72 is released and the support 26 can be pivoted about the axis A2 to an upper position (P1 of FIG. 3) or a lower position (P2 of FIG. 3) or virtually any position therebetween. Likewise, while the nut 90 is still loose, the support 26 can be rotated clockwise or counterclockwise about the axis A3, as is indicated by the unnumbered headed arrows in FIG. 6, to again position the support 26 and the gutter broom 20 in any one of a plurality of positions of rotation relative to the axis A3. Once any of the latter positions are selected, the nut 90 is tightened upon the threaded portion 82 of the bolt or member 81, again creating the interference fit between the spherical surfaces 68, 72, and this single locking means is effective for speedily, simply and reliably fixing the gutter broom 20 and its axis of rotation A1 in any one of a plurality of different positions relative to the axes A2, A3, A4 and most importantly, the surface being swept to assure that the bristles 21 "bite" into the gutter, particularly at the gutter line adjacent the curb, irrespective of the gutter/curb configuration, structure, etc.

In order to assure reliability of the connection or connecting means 60 once the nut 90 has been tightened, the collar 71 is further provided with an inverted annular locking surface 75 which is approximately 2° to a plane normal to the axis A3 of the member 81. The surface 75 extends from an axial tubular portion 76 of the member 71 which is slidably received in the opening 32 of the support bight 31 and an outermost circumferential edge 77. Thus, as the nut 90 is tightened the surfaces 68, 72 are not only brought into rigid binding connection, but the circumferential edge 77 bites into and thus is effectively locked to the bight 31 of the gutter broom support 26 thereby preventing the nut 90 from loosening and maintaining the connection 60 sound and reliable as long as need be.

Reference is also made to the fact that when the nut 90 is tightened the pin 67 (FIGS. 4 and 5) cannot accidentally or inadvertently become dislodged from the bores 65, 66. This is because the right-hand side of the pin 67, as viewed in FIGS. 4 and 5, is drawn slightly within the concave surface or concavity 72 and at axially opposite ends of the pin 67 opposes an outermost edge 78 of the surface 72. Thus, if an effort were made to view the pin 67 upwardly or downwardly, as viewed in FIG. 5, an axial end face thereof (unnumbered) at the top or bottom would simply contact the edge 78 of the spherical surface 72. However, once the nut 90 is sufficiently unthreaded the yoke 61 can be drawn to the left, again as viewed in FIG. 5, moving the bores 65, 66 totally to the left and beyond the edge 78 freeing the pivot pin 67 for removal from the bores 65, 66 and the bore 86 of the end portion 85 of the member 81.

Reference is also made to FIG. 4 of the drawings which illustrates an annular shoulder 69 of the yoke 61 which axially opposes a tapered surface 79 of the collar 71. The surfaces 69, 79 define abutment means which contact each other when the member 81 and thus the gutter broom support 26 and the gutter broom 20 carried thereby is pivoted about the axis A2 upwardly 15° or downwardly 15° as shown by the phantom outline positions P3 and P4, respectively, in FIG. 4. Thus, if the nut 90 is loosened intentionally or unintentionally, the maximum upward and downward pivoting movement of the gutter broom 20 is limited to 15°. The latter is particularly important insofar as downward pivoting is concerned, particularly should the nut 90 become inadvertently loosened while the gutter broom mechanism 10 is in its operative position. Should this occur, the inclination of the axis of rotation A1 to the vertical is obviously limited to a similar 15° and the bristles 21 of the gutter broom 20 cannot dig or bite into the surface being swept, as might occur if the gutter broom 20 simply fell or pivoted freely about the axis A2 of the pivot pin 67 without any restraint whatever. In the latter case, any number of the elements of the entire gutter broom mechanism 10 could break, bend, etc., and the latter is effectively precluded by the novel abutment means 69, 70.

Although in a preferred embodiment of the invention as has been specifically illustrated and described herein, it is to be understood that minor variations may be made in the apparatus without departing from the spirit and scope of the invention as defined in the appended claims.

I claim:

1. A gutter broom mechanism comprising an arm, a gutter broom, means for connecting said gutter broom to said arm for pivoting movement about two axes disposed generally normal to each other, means for locking said connecting means in any one of a plurality of different positions of said gutter broom relative to said arm, and said locking means including single locking means for simultaneously locking said connecting means to prevent pivoting movement about said two axes.

2. The gutter broom mechanism as defined in claim 1 wherein said connecting means includes first and second members connected to said arm and to said gutter broom respectively, first pivot means for pivotally connecting said first and second members for pivoting movement about a first of said two axes, and a third member connected to one of said first and second members and to said gutter broom for effecting pivotal movement of said gutter broom about a second of said two axes.

3. The gutter broom as defined in claim 1 wherein said connecting means includes a pivot pin connecting a plate to a rod, said plate and rod being connected to one of said arm and gutter broom, said pivot pin establishing one of said two axes of pivoting movement, and said rod establishing a second of said two axes of pivoting movement.

4. The gutter broom as defined in claim 1 wherein said connecting means includes a pivot pin connecting a plate to a rod, said plate and rod being connected to one of said arm and gutter broom, said pivot pin establishing one of said two axes of pivoting movement, said rod establishing a second of said two axes of pivoting movement, and means for establishing a curved guiding surface between said plate and rod.

5. The gutter broom as defined in claim 1 wherein said connecting means includes a pivot pin connecting a plate to a rod, said plate and rod being connected to one of said arm and gutter broom, said pivot pin establishing one of said two axes of pivoting movement, said rod establishing a second of said two axes of pivoting movement, a socket receiving said plate, said plate having an opening, said rod passes through said opening, a bracket carrying said gutter broom, and means connecting said rod to said bracket.

6. The gutter broom as defined in claim 1 wherein said connecting means includes a pivot pin connecting a plate to a rod, said plate and rod being connected to one of said arm and gutter broom, said pivot pin establishing one of said two axes of pivoting movement, said rod establishing a second of said two axes of pivoting movement to define a yoke, said plate is bifurcated and said rod is received within said bifurcated yoke.

7. The gutter broom as defined in claim 1 wherein said connecting means includes a pivot pin connecting a plate to a rod, said plate and rod being connected to one of said arm and gutter broom, said pivot pin establishing one of said two axes of pivoting movement, said rod establishing a second of said two axes of pivoting movement, said plate is a yoke defined by a pair of legs and a slot therebetween, said rod is received in said slot, and said pivot pin is received in openings of said pair of legs and rod.

8. The gutter broom as defined in claim 1 wherein said connecting means includes a pivot pin connecting a plate to a rod, said plate and rod being connected to one of said arm and gutter broom, said pivot pin establishing one of said two axes of pivoting movement, said rod establishing a second of said two axes of pivoting movement, a bracket carrying said gutter broom, and means connecting said rod to said bracket.

9. The gutter broom as defined in claim 1 wherein said connecting means includes a pivot pin connecting a plate to a rod, said plate and rod being connected to one of said arm and gutter broom, said pivot pin establishing one of said two axes of pivoting movement, said rod establishing a second of said two axes of pivoting movement, a bracket carrying said gutter broom, means connecting said rod to said bracket, and said last-mentioned connecting means being threads of said rod engaged by a nut.

10. The gutter broom as defined in claim 1 wherein means are provided for rotating said gutter broom about an axis of rotation, and said two axes lie in a plane which is normal to said axis of rotation in at least one position of said gutter broom.

11. The gutter broom as defined in claim 1 including means for establishing a curved guiding surface between said gutter broom and arm, said curved guiding surface means including first and second opposing concave and convex surface portions, and at least one of said surface portions being carried by said arm.

12. A gutter broom mechanism comprising an arm, a support carrying a gutter broom, first means connecting a rod to said arm, second means connecting said rod to said support, said first connecting means defining a first pivot, said second connecting means defining a second pivot, the axes of said first and second pivots being generally normal to each other whereby said gutter broom can pivot relative to said arm in two different planes, said gutter broom having an axis of rotation, and the axes of said first and second pivots lie in a plane which is normal to said axis of rotation in at least one position of said gutter broom.

13. The gutter broom mechanism as defined in claim 12 wherein the at least one position of said gutter broom is a position at which said axis of rotation is generally vertical.

14. The gutter broom mechanism as defined in claim 12 wherein said support includes an opening and said rod is received in said opening.

15. The gutter broom mechanism as defined in claim 12 including means between said arm and said support defining a curved guiding surface for guiding the relative pivoting movement of said support relative to said arm about said first pivot.

16. The gutter broom mechanism as defined in claim 12 including means between said arm and support defining a curved generally spherical guiding surface for guiding the relative pivoting movement of said support relative to said arm about said first pivot.

17. The gutter broom mechanism as defined in claim 12 wherein said arm includes a yoke, said rod is disposed with a first end thereof within said yoke, said first connecting means is a pivot which connects said first rod end to said yoke, said support includes an opening, and said rod includes a second end received in said opening.

18. The gutter broom mechanism as defined in claim 17 wherein said yoke and support include mating concavo-convex guiding surfaces.

19. The gutter broom mechanism as defined in claim 17 wherein said concavo-convex guiding surfaces are in part defined by a collar and said collar has an opening receiving said rod second end.

20. The gutter broom mechanism as defined in claim 19 wherein said concavo-convex guiding surfaces are generally spherical.

21. The gutter broom mechanism as defined in claim 20 wherein said support further includes a bracket carrying said gutter broom, said bracket includes an opening, and said rod second end passes through said bracket opening.

22. The gutter broom mechanism as defined in claim 21 wherein said second connecting means includes threads carried by said rod second end and a nut threaded thereupon.

23. The gutter broom mechanism as defined in claim 22 wherein said bracket is sandwiched between said collar and said nut.

24. The gutter broom mechanism as defined in claim 23 wherein said collar includes a locking surface bearing against said bracket under the force of the threaded connection between said nut and rod second end threads.

25. The gutter broom mechanism as defined in claim 23 wherein said collar includes a relieved annular surface opposing said bracket.

26. A mobile road or like surface sweeping machine comprising a frame, an arm, said arm having opposite first and second end portions, a gutter broom carried by said arm first end portion, means mounting said arm second end portion to said frame for movement of said arm between first and second positions at which said gutter broom is respectively elevated generally adjacent said frame and lowered generally outward of said frame in brushing engagement with a surface to be swept, means for moving said arm between said first and second positions, means for connecting said gutter broom to said arm first end portion for pivoting movement about two axes disposed generally normal to each other, means for locking said connecting means in any one of a plurality of different positions of said gutter broom relative to said arm, and said locking means including single locking means for simultaneously locking said connecting means to prevent pivoting movement about said two axes.

27. The mobile road or like surface sweeping machine as defined in claim 26 wherein said connecting means includes first and second members connected to said arm and to said gutter broom respectively, first pivot means for pivotally connecting said first and second members for pivoting movement about a first of said two axes, and a third member connected to one of said first and second members and to said gutter broom for effecting pivotal movement of said gutter broom about a second of said two axes.

28. The mobile road or like surface sweeping machine as defined in claim 27 wherein said first pivot means is disposed generally horizontally and normal to the longitudinal axis of said arm.

29. The mobile road or like surface sweeping machine as defined in claim 27 wherein said first pivot means is disposed generally horizontally and normal to the longitudinal axis of said arm, said gutter broom includes an axis of rotation, and said longitudinal axis and second axis are coincident when said axis of rotation is generally vertical.

30. The mobile road or like sweeping surface sweeping machine as defined in claim 29 including means for establishing a curved guiding surface between said gutter broom and arm, said curved guiding surface means including first and second opposing concave and convex surface portions, and at least one of said surface portions being carried by said arm.

31. The mobile road or like surface sweeping machine as defined in claim 27 including abutment means for limiting the pivotal movement of said gutter broom about said first pivot means.

32. The mobile road or like surface sweeping machine as defined in claim 26 wherein said connecting means includes a pivot pin connecting a plate to a rod, said plate and rod being connected to one of said arm and gutter broom, said pivot pin establishing one of said two axes of pivoting movement, and said rod establishing a second of said two axes of pivoting movement.

33. The mobile road or like surface sweeping machine as defined in claim 26 wherein said connecting means includes a pivot pin connecting a plate to a rod, said plate and rod being connected to one of said arm and gutter broom, said pivot pin establishing one of said two axes of pivoting movement, said rod establishing a second of said two axes of pivoting movement, and means for establishing a curved guiding surface between said plate and rod.

34. The mobile road or like surface sweeping machine as defined in claim 26 wherein said connecting means includes a pivot pin connecting a plate to a rod, said plate and rod being connected to one of said arm and gutter broom, said pivot pin establishing one of said two axes of pivoting movement, said rod establishing a second of said two axes of pivoting movement, a socket receiving said plate, said plate having an opening, said rod passes through said opening, a bracket carrying said gutter broom, and means connecting said rod to said bracket.

35. The mobile road or like surface sweeping machine as defined in claim 26 wherein said connecting means includes a pivot pin connecting a plate to a rod, said plate and rod being connected to one of said arm and gutter broom, said pivot pin establishing one of said two axes of pivoting movement, said rod establishing a second of said two axes of pivoting movement, to define a yoke, said plate is bifurcated, and said rod is received within said bifurcated yoke.

36. The mobile road or like surface sweeping machine as defined in claim 26 wherein said connecting means includes a pivot pin connecting a plate to a rod, said plate and rod being connected to one of said arm and gutter broom, said pivot pin establishing one of said two axes of pivoting movement, said rod establishing a second of said two axes of pivoting movement, said plate is a yoke defined by a pair of legs and a slot therebetween, said rod is received in said slot, and said pivot pin is received in openings of said pair of legs and rod.

37. The mobile road or like surface sweeping machine as defined in claim 26 wherein said connecting means includes a pivot pin connecting a plate to a rod, said plate and rod being connected to one of said arm and gutter broom, said pivot pin establishing one of said two axes of pivoting movement, said rod establishing a second of said two axes of pivoting movement, a bracket carrying said gutter broom, and means connecting said rod to said bracket.

38. The mobile road or like surface sweeping machine as defined in claim 26 wherein said connecting means includes a pivot pin connecting a plate to a rod, said plate and rod being connected to one of said arm and gutter broom, said pivot pin establishing one of said two axes of pivoting movement, said rod establishing a second of said two axes of pivoting movement, a bracket carrying said gutter broom, means connecting said rod to said bracket, and said last-mentioned connecting means being threads of said rod engaged by a nut.

* * * * *

UNITED STATES PATENT AND TRADEMARK OFFICE

CERTIFICATE OF CORRECTION

PATENT NO. : 4,691,402

DATED : September 8, 1987

INVENTOR(S) : Kenneth R. VESELKA

It is certified that error appears in the above-identified patent and that said Letters Patent is hereby corrected as shown below:

In the heading, the "assignee" was omitted and should read as follows:

Assignee: TYMCO, INC., Waco Texas

Signed and Sealed this

Twenty-third Day of February, 1988

*Attest:*

DONALD J. QUIGG

*Attesting Officer*

*Commissioner of Patents and Trademarks*